US006588610B2

(12) United States Patent
Ong et al.

(10) Patent No.: US 6,588,610 B2
(45) Date of Patent: Jul. 8, 2003

(54) ANTI-SWAY CONTROL OF A CRANE UNDER OPERATOR'S COMMAND

(75) Inventors: Chong-Jin Ong, Singapore (SG); Elmer G. Gilbert, Ann Arbor, MI (US)

(73) Assignee: National University of Singapore, Singapore (SG)

( * ) Notice: Subject to any disclaimer, the term of this patent is extended or adjusted under 35 U.S.C. 154(b) by 0 days.

(21) Appl. No.: 09/800,278

(22) Filed: Mar. 5, 2001

(65) Prior Publication Data

US 2002/0158036 A1 Oct. 31, 2002

(51) Int. Cl.[7] ..... B66C 13/06
(52) U.S. Cl. ..... 212/275; 212/270
(58) Field of Search ..... 212/275, 270

(56) References Cited

U.S. PATENT DOCUMENTS 4,756,432 A 7/1988 Kawashima et al.
5,127,533 A 7/1992 Virkkunen
5,219,420 A * 6/1993 Kiiski et al. ..... 212/275
5,443,566 A 8/1995 Rushmer et al.
5,490,601 A 2/1996 Heissat et al.
5,526,946 A * 6/1996 Overton ..... 212/275
5,550,733 A 8/1996 Yun et al.
5,785,191 A 7/1998 Feddema et al.
5,806,695 A * 9/1998 Hytonen ..... 212/270
5,878,896 A 3/1999 Eudier et al.
5,909,817 A 6/1999 Wallace, Jr. et al.
5,960,969 A * 10/1999 Habisohn ..... 212/275

* cited by examiner

*Primary Examiner*—Thomas J. Brahan
(74) *Attorney, Agent, or Firm*—Pandiscio & Pandiscio

(57) ABSTRACT

A system is disclosed for eliminating sway of a load in a crane or crane-like system subject to operator's command. The load is suspended by a cable from a horizontally movable trolley and can be hoisted vertically. The system uses the principle of cancellation to eliminate sway even when the crane has simultaneous horizontal trolley and vertical hoisting motions. The system takes into account the full dynamical effect in computing cancellation signals. The use of a family of ordinary differential equations for the computation of the cancellation controls is a key component of the invention. In computing these controls, the differential equations are solved in real time using sensory measurement of the cable length and its time derivative.

43 Claims, 2 Drawing Sheets

ANTI-SWAY CONTROL OF A CRANE UNDER OPERATOR'S COMMAND

FIELD OF THE INVENTION

This invention relates to systems and methods for controlling cable suspended, payload transfer systems. More particularly, this invention relates to anti-sway control systems and methods for a payload undergoing both horizontal trolley and vertical hoisting motions.

BACKGROUND OF THE INVENTION

Gantry-style cranes are used extensively for the transfer of containers in port operation. Typically, a crane has two inputs in the form of velocity commands. These two velocity commands independently control horizontal trolley and vertical hoisting motions of a payload. Undesirable swaying of a payload at the end of the transfer is one difficulty in accomplishing a transfer movement. Loading or unloading operations cannot be accomplished when a payload is swaying. Presently, only an experienced operator can efficiently bring the container to a swing-free stop. Other operators must wait for the sway to stop. Typically, the time spent waiting for the sway to stop, or the various maneuvers to fine position the load, can take up to one-third of the total transfer time.

Various prior art patents teach sway reduction systems. These patents relate to different aspects of payload transfer with reduced sway. For example, several patents describe operation in autonomous mode where system uses the starting and ending positions of the payload to generate the necessary control signals to achieve the payload transfer. Other non-autonomous systems attempt to minimize the amount of payload sway while following the operator's commands for horizontal trolley and vertical hoisting motions.

Autonomous systems are suitable for structured environments where positions of a payload are well identified, In a typical port environment, a container's position depends on the relative positioning of the ship relative to the crane. Therefore, the position of the container is rarely precisely known. In such an environment, a non-autonomous mode of operation is preferred. The present invention relates to such non-autonomous systems.

Several references disclose non-autonomous modes of operation. Many of these references use a fixed-length pendulum model as the basis for their sway reduction method and/or system. Consequently, these strategies do not eliminate sway when the cable length changes during horizontal motion. Several other references handle the effect of changing vertical cable length by using approximations. The present invention uses the full dynamical equation of a crane system without approximation in order to avoid error and to eliminate sway. In particular, the present invention uses cancellation acceleration for sway control. The computation of a cancellation signal is exact as it is based on the full dynamical equation of the crane model. This is particularly significant during simultaneous trolley and hoist motions. For the ease of discussion, the angle of sway of the load and the velocity of sway of the load are shown as $\theta$ and $\dot{\theta}$, respectively, and the acceleration of the trolley is referred to as $\chi$. All control systems use the horizontal acceleration of the trolley as the control for sway. Hence, horizontal acceleration is also termed the control.

There are two general approaches for sway minimization. In first approach, the trolley acceleration is given in the form $\ddot{x}=r+k_1\theta+k_2\dot{\theta}$ or something similar. Here, the value r is a time function that depends on the desired motion of the trolley. The use of this approach introduces additional damping into the system to control sway. The resultant system can be made to have any desirable damping ratio and natural frequency using the appropriate values of $k_1$ and $k_2$.

Several references adopt this first approach. These references differ in the profile of the motion dependent time function, r, and the specific procedure by which values of the damping ratios, $k_1$ and $k_2$, are determined. In the U.S. Pat. No. 5,443,566 to Rushmer, sway angle and sway angle velocity are estimated using a fixed-length cable model of the crane. Estimates of the sway angle, $\theta$, and the sway angle velocity, $\dot{\theta}$, are used together with the input velocity demand from the operator, $\dot{x}_d$, to compute the control signal $\ddot{x}=k_1(\dot{x}_d-\dot{x})+k_2\theta+k_3\dot{\theta}$. In U.S. Pat. No. 5,490,601 to Heissat et al., the control signal is $\ddot{x}=k_1\theta+k_2\dot{\theta}+k_3(x_d-x)$. Sets of $k_1$, $k_2$, and $k_3$ are determined experimentally at various lengths of the cable. The exact values of $k_1$, $k_2$, and $k_3$ for a particular cable length are interpolated from these experimental sets using gain scheduling, or some form of fuzzy or neural network control. In U.S. Pat. No. 5,878,896 to Eudier et al., the speed demand send to the trolley is of the form $\dot{x}_d=k_1\theta+k_2\dot{\theta}+k_3(x_d-x)$ where $x_d$ is the desired position of the trolley. The values of $k_1$, $k_2$, and $k_3$ are determined experimentally.

This first approach can effectively damp out sway. The approach is based on standard mechanism of feedback and is therefore robust against model inaccuracies. The main disadvantage of this approach is its lack of intuitive control by the operator. As the trolley acceleration depends on $\theta$, $\dot{\theta}$ and the operator's desired velocity, the motion of the trolley can be unpredictable and counter-intuitive to the operator. As a result, several manuevers may be needed to bring the system to a proper stop. As such, this first approach is suitable for an unmanned crane in a structured environment where payload position is well identified.

A second approach is based on the principle of sway cancellation. This is the mechanism used by most human operators for sway damping. The basic idea of this approach for a fixed-length pendulum is described in *Feedback Control Systems*, McGraw-Hill, New York, 1958, by O. J. Smith. In a fixed-length pendulum, the sway motion is a nearly sinusoidal time function with a frequency $\omega$, defined by $\omega=\sqrt{g/l}$. Suppose that a short pulse of horizontal acceleration is applied at time t=0, this pulse will induce a sway oscillation of frequency $\omega$. It is possible to cancel this oscillation using a second short pulse of the same magnitude and duration applied at time $t=\pi/\omega$. After the application of the second pulse, the system will have no sway for the time thereafter. This method, known as double-pulse control or cancellation control, gives the shortest possible settling time for a constant length cable. While this method is readily applicable to a fixed-length pendulum, extensions to pendulums with varying cable length extension are not easy.

Several references teach the general approach of cancellation control. In U.S. Pat. No. 4,756,432 to Kawashima et al., it appears that double-pulse control is used in both the acceleration and deceleration phases of the trolley motion. For a specified final trolley location, the timing and magnitude of these pulses are computed based on a fixed-length pendulum. One double-pulse is used in each of the acceleration and deceleration phases. In between these two phases, the trolley travels at constant velocity and does not sway. In order for this method to work, the operator must provide the final position of the trolley to accurately determine the timing and magnitude of the pulses. This system works reasonably well when the cable length is constant during horizontal motion.

In U.S. Pat. No. 5,219,420 to Kiiski et al., it appears that the sway angle is measured and a best fit sinusoidal time function is made of the sway motion. With this estimated sinusoidal function, a cancellation pulse is generated to eliminate sway. The method assumes the presence of only one sinusoidal frequency. As such, the method is not effective for systems which the cable length changes during horizontal motion of the trolley.

In U.S. Pat. No. 5,960,969 to Habisohn, a digital filter is used for damping oscillation. It appears that components of the input signal close to the crane oscillation frequency are filtered off. In particular, the filtered output is a simple average of the input signal and the input signal delayed by a one-half period of the load pendulum motion. Several other filter versions based on linear combinations of input signals with different delays are used. These input signals are computed using the constant length version of the crane equation.

The methods in the above references rely on constant-length pendulum systems for cancellation. The following references review other attempts to extend cancellation control to varying-length cable systems.

In U.S. Pat. No. 5,785,191 to Feddema et al., an impulse response filter and a proportional-integral controller is disclosed for the control of the crane under the operator's input. The impulse filter based on a digital implementation of an inverse dynamics idea is commonly used in the study of control systems. In this case, a feed forward controller is used to cancel the dynamics of the crane system and to introduce user-defined dynamics.

In U.S. Pat. No. 5,127,533 to Virrkkumen, an attempt to adapt a control design for a crane having a fixed-length cable to a control design for a crane having a variable-length cable is disclosed. It is well known that the period of oscillation of a pendulum is proportional to the square root of the pendulum length. The reference shows that a control signal applicable for a crane having a fixed cable length, referred to as $L_1$, can be used for the crane having another cable length, referred to as $L_2$, by a suitable delay. For example, suppose the control signal is based on a crane design for a fixed length, $L_1$, and the control signal is applied at a first time, $t_1$. Virrkkumen teaches that the same effect can be achieved on the crane having another fixed length, $L_2$, when the control signal is applied at time:

$$t_2 = t_1 * \frac{\sqrt{L_2}}{\sqrt{L_1}}$$

While the method of Virrkkumen is reasonable for two fixed-length pendulums, it is not accurate for a single pendulum, or a single crane, undergoing a change in cable length. For example, the hoisting rate of the cable affects the sway angle, and this is not accounted for in Virrkkumen. In addition, there is the uncertainty in the determination of the second cable length, $L_2$, as the length may be changed continuously during a typical horizontal motion.

In U.S. Pat. No. 5,526,946 to Overton, the basic sway control teaching is an extension of Kawashima and Virrkkumen. Instead of a fixed double-pulse at the acceleration and deceleration phases, Overton teaches the use of double-pulse whenever there is a change in the velocity input. For a sequence of continuously changing velocity input, two sequences of pulses are generated. The first sequence is synchronized with the input velocity change. The second sequence is also generated and then stored. The second sequence corresponds to a second pulse of the double pulse control method. Each of the signals in the second sequence is applied to the horizontal acceleration of the trolley at about one-half of a pendulum period after the signal in the first sequence. Overton adapts Virrkkumen in calculating the timing of these signals. This second sequence is processed (or sent as trolley acceleration) at a variable rate proportional to the current length of the cable. The shorter the cable length, the faster the entries of the sequence are sent out. As Overton is an adaptation of Virrkkumen, it suffers from similar deficiencies.

The present invention uses double pulse control for sway cancellation. However, the present invention differs from the references above in several significant aspects. The present invention computes the exact timing and magnitude of a second pulse using the full dynamic equation of the crane system. The application of this second pulse eliminates sway even during changing cable length. This precise cancellation pulse computation is crucial for proper sway elimination. The present invention also ensures that physical constraints, in the form of acceleration and velocity limits of the trolley, are never exceeded. The present invention also includes a feedback mechanism to eliminate sway due to external forces, such as wind load and other external disturbances.

SUMMARY OF THE INVENTION

An object of the present invention is to provide a computer-controlled system for the control of sway in a crane. The present invention uses cancellation pulses for sway control. Sway is incrementally canceled after being induced by prior commands for trolley acceleration. The timing and magnitude of these cancellation pulses are critical components to the effectiveness of the present anti-sway method. The present invention also takes into account the full dynamic effect of the varying cable length in the computation of these cancellation signals.

Another object of the present invention is to determine precise cancellation acceleration pulses. By using a family of ordinary differential equations, the precise cancellation acceleration pulses are determined.

A further object of the present invention is the operation of the anti-sway system and method within the acceleration and velocity limits of the trolley drive system. Sway control can be adversely affected when acceleration saturation or velocity saturation of the trolley drive system occurs. The present invention includes a system and method to ensure the proper functioning of the anti-sway mechanism within these limits.

Yet another object of the present invention is to provide an anti-sway controller unit or kit for incorporation into an existing crane system. The anti-sway controller unit is connected between the operator's velocity commands and the existing variable speed controllers. This anti-sway controller follows an operator's input commands for both horizontal trolley travel and vertical payload hoisting. The controller unit can be switched off, if so desired, to restore manual operator control of the crane.

Still another object of the present invention is residual sway elimination. Using sensory measurement of the sway the present invention is further enhanced by a feedback mechanism. This feedback mechanism complements the anti-sway controller and eliminates residual sway due to external factors.

Still other objects of the present invention will become readily apparent to those skilled in this art from the following detailed description, wherein a preferred embodiment of the invention is shown and described by way of illustration of the best mode contemplated of carrying out the invention. As will be realized, the invention is capable of modifications in various obvious respects, all without departing from the invention. Accordingly, the drawing and description are to be regarded as illustrative in nature, and not as restrictive.

BRIEF DESCRIPTION OF THE DRAWINGS

The present invention may be better understood with reference to the detailed description in conjunction with the following figures.

DESCRIPTION OF THE PREFERRED EMBODIMENTS OF THE INVENTION

Figure 1:
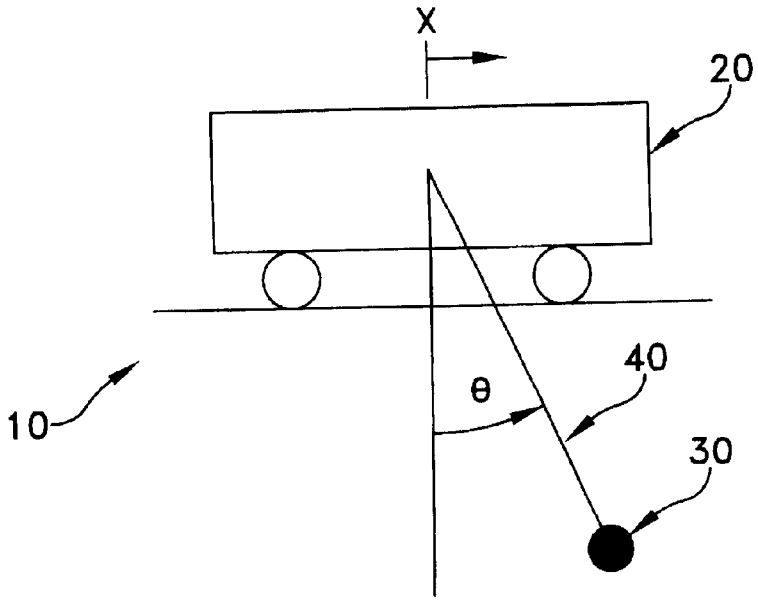
FIG. 1 is a diagram of a crane with a payload suspended from a trolley.

Referring to FIG. 1, a model of a crane system 10 is shown. Crane system 10 includes a trolley 20 having a hoist (not shown) to adjustably suspend a payload 30 from a cable 40. A sway angle θ is created between the position of cable 40 at rest and the position of cable 40 during sway oscillation. A differential equation describing the time evolution of the sway angle θ for payload 30 is:

$$l(t)\theta(t)+2\dot{l}(t)\dot{\theta}(t)+g\sin\theta(t)=\ddot{x}(t)\cos\theta(t) \tag{1}$$

In equation (1), $l(t)$ and $\dot{l}(t)$ refer to the time dependent length of cable 40 and its derivative, respectively, and $\ddot{x}(t)$ refers to the trolley acceleration. At the time when the crane operation is first initiated, the system is at rest, i.e., $\theta(0)=\dot{\theta}(0)=0, x(0)=x_0, \dot{x}(0)=0, l(0)=l_0, \dot{l}(0)=0$. For the ease of presentation, these initial conditions are chosen. It is also possible to extend this derivation for a more general set of initial conditions.

Since the magnitude of sway angle $\theta(t)$ is fairly small throughout the ensuing motion, an approximation is possible. Following the standard engineering practice of assuming that $\sin\theta(t)\cong\theta(t)$ and $\cos\theta(t)\cong 1$, an approximation is made. Thus, the equation of motion is approximated by:

$$l(t)\theta(t)+2\dot{l}(t)\dot{\theta}(t)+g\theta(t)=\ddot{x}(t) \tag{2}$$

with $\theta(0)=\dot{\theta}(0)=0$.

Figure 2:
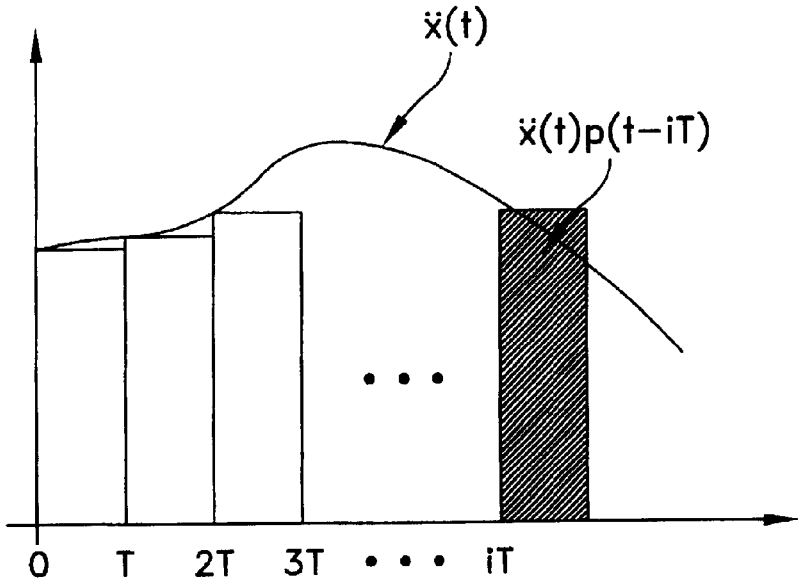
FIG. 2 is a graphical representation of an operator's input signal as a piecewise constant acceleration signal.

Now looking at FIG. 2, the compensation scheme depends on representing the acceleration of trolley 20 at a given time, $\ddot{x}(t)$, as the sum of narrow pulses of the form:

$$\ddot{x}(t)=\sum_i \ddot{x}(iT)p(t-iT) \tag{3}$$

where the function $p(\cdot)$ is defined by:

$$p(t)=0,\ t<0 \tag{4a}$$

$$p(t)=1,\ t\leqq 0<T \tag{4b}$$

$$p(t)=0,\ t\leqq T \tag{4c}$$

In one preferred embodiment of the invention, only a first pulse, $\ddot{x}(0)p(t)$, is present. When the duration of the acceleration pulse T is small, the sway angle response to the pulse, symbolized as $\delta\theta_0(t)$, is determined by the solution of the following differential equation:

$$l(t)\delta\ddot{\theta}_0(t)+2\dot{l}(t)\delta\dot{\theta}_0(t)+g\delta\theta_0(t)=0 \tag{5}$$

$$\delta\theta_0(0)=0,$$

$$\delta\dot{\theta}_0(0)=\frac{\text{strength of pulse}}{l(0)}=\frac{T\cdot\ddot{x}(0)}{l(0)}$$

If all of the acceleration pulses are present, the response to an arbitrary acceleration of trolley 20 at a given time, $\ddot{x}(t)$, in equation (3) is:

$$\theta(t)=\sum_i \delta\theta(t)\cdot 1(t-iT) \tag{6}$$

Here, the function $1(t-iT)=1$, when $t>iT$; and the function $1(t-iT)=0$, otherwise. Each sway angle response, $\delta\theta_i(t)$, is defined by:

$$l(t)\delta\ddot{\theta}_i(t)+2\dot{l}(t)\delta\dot{\theta}_i(t)+g\delta\theta_i(t)=0, \tag{7}$$

$$\delta\theta_i(iT)=0,$$

$$\delta\dot{\theta}_i(t)=\frac{T\cdot\ddot{x}(iT)}{l(iT)}$$

Note that sway angle $\theta(t)$, as computed in equation (6), depends on the linearity of differential equation (2). Modeling errors introduced by the approximations of $\sin\theta(t)$ and $\cos\theta(t)$, as $\sin\theta(t)\cong\theta(t)$ and $\cos\theta(t)\cong 1$, respectively, can be corrected using a transformation as shown below.

We now consider an expression for generating a cancellation signal to counter the effect of the first pulse, $\ddot{x}(0)p(t)$. In solving the linear time-varying differential equation (7) for i=0 let $\tilde{t}_0$ be the first time after t=0 where the sway angle response, $\delta\theta_0(t)$, becomes zero, i.e. $\delta\theta_0(\tilde{t}_0)=0$. At time $\tilde{t}_0$, there is a corresponding velocity $\delta\dot{\theta}_0(\tilde{t}_0)$. Suppose a correction pulse, $x_0^c(t)$, is applied at time $\tilde{t}_0$ for a duration of T:

$$x_0^c(t)=-\frac{\delta\dot{\theta}_0(\tilde{t}_0)\cdot l_0(\tilde{t}_0)}{T}\cdot p(t) \tag{8}$$

It is evident that after the application of this correction pulse, $x_0^c(t)$, both the sway angle, $\delta\theta_0(\tilde{t})$, and the sway angle velocity, $\delta\dot{\theta}_0(\tilde{t})$, are close to zero. The error of approximation can be reduced to essentially zero by choosing T sufficiently small. Thus, when the correction pulse has occurred, $\delta\theta_0(t)$ is essentially zero for $t\geqq t_0$.

The determination of $\tilde{t}_0$ and $\delta\dot{\theta}_0(\tilde{t}_0)$ is accomplished using an Ordinary Differential Equation (ODE) solver for equation (7). Since equation (7) is a time-varying system, this solver acts in real time using sensory information of the time dependent length of cable 40 and its derivative, $l(t)$ and $\dot{l}(t)$, respectively. Depending on the choice of the solver used, it may be necessary to measure the time dependent length of cable 40 and its derivative, $l(t)$ and $\dot{l}(t)$, respectively, on smaller intervals than T, e.g., at t=iT and at iT+T/2.

The discussion above is for the first pulse at time t=0.

Figure 3:
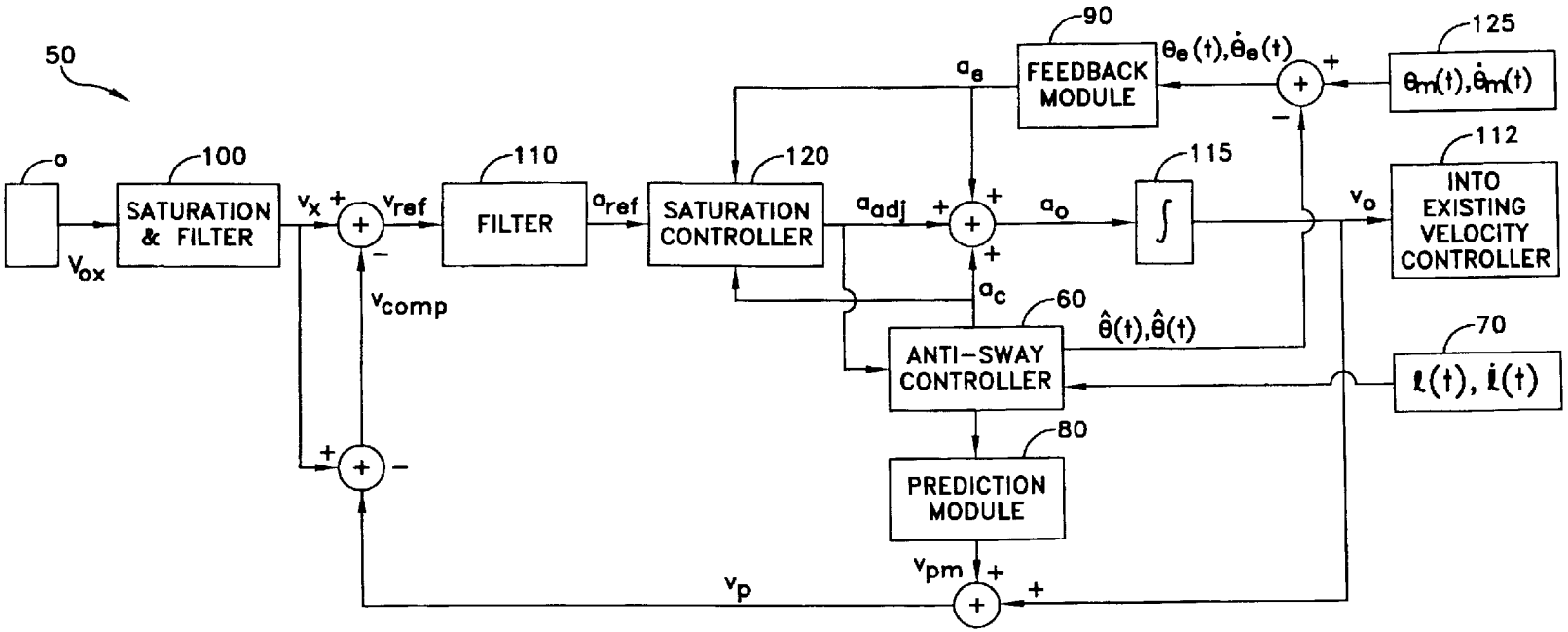
FIG. 3 is a block diagram showing interconnected functional blocks of an anti-sway system.

Now looking at FIG. 3, the overall response of an anti-sway system 50 is a summation of sway angle response, $\delta\theta_i(t)$, over the entire interval, i, as shown in equation (6). A new ODE solver is created at the beginning of each discrete time period, t=iT. This ODE solver is carried in the anti-sway system 50 for as long as it is needed, i.e., until the sway angle response is zero, $\delta\theta_i(t)=0$, at $t=\tilde{t}_i$. When $\tilde{t}_i$ and $\delta\dot{\theta}_i(\tilde{t}_i)$ are determined, the correction pulse is applied at the next available sample time, i.e., at t=jT where j is the smallest j such that $jT \geqq \tilde{t}_i$. After t=jT, use of the ith ODE solver is terminated. An entire family of ODE solvers is kept in action as real time evolves. This multiple, real-time solution of differential equations allows system 50 to handle, in a highly accurate way, the effect of sway created by operator commands for time-varying horizontal trolley position and vertical cable length.

Still looking at FIG. 3, a preferred embodiment of anti-sway system 50 block diagram is shown. An anti-sway controller 60 implements the multiple ODE system using the system described above. Anti-sway controller 60 has two inputs and three outputs. The principal input is an adjusted operator's command acceleration, $a_{adj}$. Another input providing a measurement signal of cable length 40 and a time derivative of cable length 40, l(t) and $\dot{l}(t)$, respectively, is received from a sensor 70 as needed for the ODE solver. The principal output is a cancellation acceleration signal, $a_c$, the equivalent of correction pulse, $\ddot{x}_0^c$ in equation (8). Two. other outputs from anti-sway controller 60 are connected to a prediction module 80 and a feedback module 90, respectively. The functions of prediction module 80 and feedback module 90 are discussed below. A pair of saturation and filter components 100, 105 each filter the high frequency components of an operator's command horizontal trolley and vertical hoist velocity input signals, $V_{0X}$ (see FIG. 3) and $V_{0L}$ (see FIG. 4), respectively. The input signals are received from a pair of joysticks (not shown). Saturation and filter components 100, 105 also set the maximum allowable velocities of the horizontal trolley and the vertical hoist motions, respectively.

Figure 4:
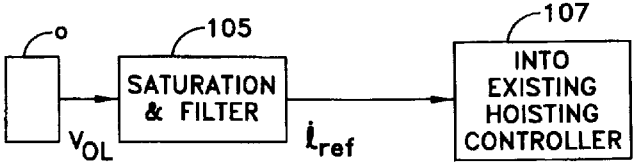
FIG. 4. is a block diagram showing interconnected functional blocks of an anti-sway system.

Referring now to FIG. 4, saturation and filter 105 also converts the vertical velocity input, $V_{0L}$, into a cable velocity demand signal, $\dot{l}_{ref}$. The cable velocity demand signal, $\dot{l}_{ref}$ is then sent to a velocity controller 107 of the existing crane system for the hoisting drive system of the cable.

Looking again at FIG. 3, a filter component 110 is shown. Filter component 110 reduces a velocity demand signal, referred to as $v_{ref}$, by one-half to account for the delayed effect of the cancellation signal, $a_c$. Filter 110 also converts the velocity demand, $v_{ref}$, into corresponding acceleration demand signals, $a_{ref}$, by differentiation. The velocity demand signal, $v_{ref}$, has two components, a filtered operator's command velocity, referred to as $v_x$, and a compensation signal, referred to. as $v_{comp}$. The compensation signal component, $v_{comp}$, is needed to compensate for the discrepancy between the desired velocity of the operator's command velocity, $v_x$, and a velocity output signal, referred to as $v_o$. This discrepancy arises from the action of anti-sway controller 60.

The overall anti-sway system 50 output is the velocity output signal, $v_o$, and is sent to an existing velocity controller 112 for the drive system of the trolley 20. An output signal, $v_o$, is the integral sum, shown as 115, of three signals: the adjusted operator's command acceleration, $a_{adj}$, the cancellation acceleration signal, $a_c$, and the external factor reduction acceleration, $a_e$. The acceleration signal, $a_{adj}$, results from the operator's command. The cancellation acceleration signal, $a_c$, cancels sway induced by prior adjusted operator's command acceleration $a_{adj}$. The external factor reduction acceleration signal, $a_e$, reduces sway due to external factors such as wind load.

Anti-sway system 50 fails to operate properly if the input demand, $v_{ref}$, to the system exceeds the velocity or acceleration limits on trolley 20. A saturation controller 120 functions as a velocity and acceleration limit to handle this situation. Controller 120 enforces the velocity and acceleration limits, $v_{max}$ and $a_{max}$, respectively, of trolley 20. These limits are usually known, or can be easily estimated. Hence, it is necessary to ensure that $|v_0(t)| \leqq v_{max}$ and $|\dot{v}_0(t)| \leqq a_{max}$ at all times. Since the signals for the adjusted operator's command acceleration, the acceleration cancellation, and the external factor reduction acceleration, $a_{adj}$, $a_c$, and $a_e$, respectively, are piecewise constant and change only at the sample time kT, it follows that the velocity output, $v_o(t)$, is piecewise linear and continuous. This is useful for the design of the saturation controller 120.

Continuing to look at FIG. 3, saturation controller 120 receives the following input signals: the acceleration demand reference signal, $a_{ref}$, the cancellation acceleration signal, $a_c$, and the external factor reduction acceleration feedback signal, $a_e$. Saturation controller 120 produces the adjusted operator's command acceleration, $a_{adj}$, as an output signal. The basic idea is to let:

$$a_{adj}=\lambda a_{ref} \tag{9}$$

and to choose the value of a constraint factor, referred to as $\lambda$, as close to 1 as possible subject to the acceleration and velocity constraint limits. The acceleration and velocity constraints can be stated as:

$$|a_c+a_e+\lambda a_{ref}| \leqq a_{max} v_o^- + T(a_c+a_e+\lambda a_{ref})| \leqq v_{max} \tag{10}$$

The output velocity variable $v_0^-$ refers to the output velocity, $v_0$, at a previous time, such as $v_0(kT-T)$, while the rest of the variables are all signals at a current time kT. These two constraints can be equivalently stated as:

$$\max\{-a_{max},(-v_o^- - v_{max})/T\} \leqq a_c+a_e+\lambda a_{ref} \leqq \min\{a_{max},(-v_o^- + v_{max})/T\} \tag{11}$$

The objective is, to find an optimal constraint factor, referred to as $\lambda_m$, which is the optimal $\lambda$ for the following optimization problem:

$$\text{Min}|\lambda-1|$$

subject to the constraints of equation (11). Since the optimization problem is for a single variable subject to two constraints, the optimal constraint factor, $\lambda_m$, can be easily computed. The exact expression for the adjusted operator's command acceleration, $a_{adj}$, can be shown to be:

$$a_{adj} = \lambda_m a_{ref} = \begin{cases} a_u - a_c - a_e & \text{if } a_{ref} \geq a_u \\ a_l - a_c - a_e & \text{if } a_{ref} \leq a_l \\ a_{ref} & \text{otherwise} \end{cases} \tag{12}$$

$$\text{where } a_u = \min\left\{a_{\max}, \frac{-v_o + v_{\max}}{T}\right\} \text{ and}$$

$$a_l = \max\left\{-a_{\max}, \frac{-v_o - v_{\max}}{T}\right\}.$$

Again looking at FIG. 3, prediction model 80 and the connections of the prediction model velocity change component signal, $v_{pm}$, the estimated velocity of the velocity output signal, $v_p$, and the velocity compensation signal, $v_{comp}$, are arranged to create a steady-state value of the output velocity signal, $v_o$, equal to the steady-state value of the filtered operator's velocity command, $v_x$. In other words, the system velocity output, $v_o$, is responsive to the filtered operator's velocity command, $v_x$. The input of prediction module 80 is the entire collection of ODEs residing in anti-sway controller 60 at the current time. A bold arrow from anti-sway controller 60 to prediction model 80 displays this relationship. The output of prediction module 80 is the prediction model velocity change component signal, $v_{pm}$. The value of prediction model velocity change component, $v_{pm}$, is the predicted change in the velocity output signal, $v_o$, when all of the compensation signals in the ODEs of anti-sway controller 60 have been sent out. The computation of prediction model velocity change component, $\dot{v}_{pm}$, is described below. Suppose there are M ODEs in anti-sway controller 60 at the current time of t=kT and they are represented as a collection of state vectors $[\delta\theta_i(kT)\ \delta\dot{\theta}_i(kT)]$ for i=1, . . . , M. Prediction module 80 assumes that the length of cable 40 remains unchanged after the current time, t=kT. The prediction model correction acceleration signal, $\ddot{x}_i^{pm}$, is then computed. For example, let us consider the case of i=1. It is possible to integrate from the current time, t=kT, with an initial condition $[\delta\theta_1(kT)\ \delta_1\dot{\theta}(kT)]$ until the corresponding time, $\tilde{t}_1$, using the ODE solver. The corresponding prediction model correction acceleration signal, $\ddot{x}_1^{pm}$, can then be computed using equation (8). Prediction module 80 computes each of the M ODEs and then computes a summation of the compensating accelerations. The output for the prediction model velocity change component, $v_{pm}$, is:

$$v_{pm}(t) = T \cdot \sum_{1}^{M} \ddot{x}_i^{pm}(\tilde{t}_i) \tag{13}$$

representing additional future velocity demand due to the anti-sway controller 60.

Additionally, when the operator's hoisting velocity command becomes zero, the cable length remains constant thereafter. Thus, the constant cable length assumption used in the prediction module 80 is satisfied in the final phase of the transfer motion. This is all that is needed to eliminate terminal sway.

In the above computation, the prediction module correction acceleration signal, $\ddot{x}_i^{pm}$, is computed using the ODE solver. Assuming a constant length of cable 40, an energy approach is more computational efficient to compute the prediction module correction acceleration signal, $\ddot{x}_i^{pm}$. When the length of cable 40 remains unchanged, the crane 10 is a pendulum with constant total energy in a conservative system. Again, suppose the initial condition is $[\delta\theta_1(kT)\ \delta\dot{\theta}_1(kT)]$ at a time, t=kT, the total energy is $$\frac{1}{2}ml\delta\dot{\theta}_1(kT)^2 + mgl(1-\cos(\delta\theta_1(kT))).$$

Hence, the sway angle response velocity, $\delta\dot{\theta}_1(\tilde{t}_1)$, can be shown as:

$$\delta\dot{\theta}_1(\tilde{t}_1)=(\delta\dot{\theta}_1(kT)^2+2g(1-\cos\ \delta\theta_1(kT)))^{0.5} \tag{14}$$

Using equation (14), the corresponding prediction module correction acceleration signal, $\ddot{x}_i^{pm}$, can be computed from equation (8) with $l(\tilde{t})=l(kT)$.

The estimated velocity signal, $v_p$, is the estimated velocity output, $v_o$, when all the entries in anti-sway controller 60 are sent out. The velocity output estimated velocity signal, $v_p$, is compared with the operator's command trolley velocity signal, $v_x$, to determine the compensation velocity, $v_{comp}$. The compensation velocity, $v_{comp}$, represents the discrepancy between the desired velocity signal, $v_x$, and the future value of velocity output signal, $v_o$. The compensation velocity, $v_{comp}$, is added to the filtered operator's command velocity command, $v_x$, to compute the velocity demand, $v_{ref}$, such that $v_{ref}=v_x+v_{comp}$.

The configuration of anti-sway system 50 using the various components described above is sufficient to cancel sway induced by the operator's commands in both horizontal and vertical velocity input signals, $V_{OX}$ and $V_{OL}$, respectively. Sway can also be induced by external factors, such as wind load or lateral impact forces on the payload during loading and unloading. However, anti-sway controller 60 using the cancellation methods and system described above does not eliminate sway caused by external factors. A feedback module 90 is provided to eliminate sway due to external factors and sway resulting from any nonconformity between the parameters of the model and the actual physical system.

Feedback module 90 uses as input a sway angle error signal and a sway angle error velocity, represented by $\theta_e$ and $\dot{\theta}_e$, respectively. The sway angle and sway angle velocity error signals, $\theta_e$ and $\dot{\theta}_e$, are computed from the expressions $\theta_e(t)=\theta_m(t)-\hat{\theta}(t)$ and $\dot{\theta}_e(t)=\dot{\theta}_m(t)-\hat{\dot{\theta}}(t)$ where $\theta_m$ and $\dot{\theta}_m$ represent the sway angle and the sway velocity of the physical crane as measured by an appropriate sensor, respectively. An example of a sensor that measures sway angle and sway angle velocity is the infrared beacon system SIRRAH offered by GIAT Industries, from Toulouse, France. $\hat{\theta}(t)$ and $\hat{\dot{\theta}}(t)$ represent the sway angle.and sway velocity of crane 10, respectively, based on the model of crane 10 in anti-sway controller 60. The model sway angle, $\hat{\theta}$, is computed from the family of ODEs in anti-sway controller 60. More precisely, suppose there are M ODEs in anti-sway controller 60 at the current time, t=kT, with each ODE having the state vector of $[\delta\theta_i(kT)\ \delta\dot{\theta}_i(kT)]$. The sway angle, $\hat{\theta}(t)$, and the sway velocity, $\hat{\dot{\theta}}(t)$, based on the model are respectively given by:

$$\hat{\theta}(kT) = \sum_{1}^{M} \delta\theta_i(kT), \tag{15a}$$

$$\hat{\dot{\theta}}(kT) = \sum_{1}^{M} \delta\dot{\theta}_i(kT). \tag{15b}$$

Hence, the sway angle and sway velocity of payload 30 caused by factors other than the operator's command, as represented by $\theta_e$ and $\dot{\theta}_e$, are eliminated by feedback module 90.

Feedback module 90 generates a feedback external factor reduction acceleration signal, $a_e$. Feedback control law converts the external factor sway angle and the external factor sway angle velocity, $\theta_e$ and $\dot{\theta}_e$, respectively, to an extended factor reduction acceleration, represented as $a_e$. This conversion can be accomplished in several ways. In the preferred embodiment, a simple control law is used. A person having ordinary skill in the art of control, or related discipline, can easily modify or replace this control law. using various techniques. One choice for such a control law is:

$$a_e=k_e\dot{\theta}_e. \tag{16}$$

For an appropriate choice of $k_e$, this control law will damp out sway induced by external factors. If the effect of the external factors is large, the acceleration signal, $a_e$, may cause the trolley to oscillate. Therefore, it is advisable to limit the magnitude of the acceleration signal, $a_e$.

In another modification of the preferred embodiment, the trigonometric approximations that have been made in going from the original system representation of equation (1) to the approximate representation of equation (2) are considered. These approximations can be eliminated if the following transformation is substituted into equation (1):

$$\ddot{x}(t) = \frac{\tilde{u}(t) + g(\sin\theta(t) - \theta(t))}{\cos\theta(t)} \tag{17}$$

Then $$l(t)\theta(t)+2\dot{l}(t)\dot{\theta}(t)+g\theta(t)=\tilde{u}(t) \tag{18}$$

and there are no trigonometric approximations. Clearly, equation (18) has the same structure as equation (2) with $\tilde{u}(t)$ as the input. Thus, the above development of correction pulses applies directly by replacing $\ddot{x}(t)$ in equation (2) by the new input $\tilde{u}(t)$ The limit on the new input $\tilde{u}(t)$, has the form $|u(t)| \leqq \tilde{a}_{max}$ where the transformation acceleration limit, $\tilde{a}_{max}$, is determined from equation (17) by requiring that the cancellation acceleration does not exceed the acceleration limit, i.e. $|\ddot{x}(t)| \leqq a_{max}$, for all expected values of the sway angle $\theta$. For reasonable variations of the sway angle $\theta$ the transformation acceleration limit, $\tilde{a}_{max}$, is only slightly less than the acceleration limit, $a_{max}$.

Corrections to other modeling errors can also be implemented. Suppose, that the left side of equation (1) includes an added nonlinear damping term of the form $c\dot{\theta}(t)+f(\dot{\theta}(t))$. This damping term can be introduced by passive damping devices or as part of the control law. Then, the term $c\dot{\theta}(t)$ is added to the right side of equation (2) and the term $-f(\dot{\theta}(t))$ is added to the numerator in equation (17). Then, this embodiment is similar to the preferred embodiment as shown above with the exception that the nonlinear damping term $c\delta\theta_l(t)$ is added to the right side of equation (7).

The embodiment as described above is easily modified to control a crane having multiple hoisting cables attached to the payload. There are several ways of doing this. One way is to change the form of the differential equation to agree with the dynamics of the multiple-cable system. Another is to represent the dynamics of a multiple-cable system with the dynamics of an equivalent single-cable system using an appropriate length of the cable. The equivalent length to be used for the multi-cable system depends on the arrangement of the cables. It can be obtained either analytically or via a calibration process on an actual crane.

A preferred embodiment described above includes a feedback module 90 to handle sway induced by external disturbances. If the operating environment of a crane is such that the external disturbances are negligible, or highly predictable, the invention can be implemented without the feedback module 90 and the associated sway sensor 125.

What is claimed is:

1. A system for eliminating sway of a payload suspended by a cable attached to a hoist from a trolley, the position of said payload being vertically and horizontally adjustable, said system including means for receiving or for generating an operator's hoist velocity input signal for vertical adjustment of said payload and including means for generating an operator's trolley velocity input signal for horizontal translation of said payload suspended by said cable, said system comprising:

means for generating an adjusted operator's command acceleration signal from said operator's trolley velocity input signal;

means for generating a cancellation acceleration signal using the length of said cable, the time derivative of the length of said cable, and said adjusted operator's command acceleration signal;

means for generating an external factor reduction acceleration signal using a measured sway angle of said payload, a measured sway velocity of said payload, a model sway angle of said payload and a model sway velocity of said payload;

means for generating a velocity output signal based on said adjusted operator's command signal, said cancellation acceleration signal and said external factor reduction acceleration signal;

means for sending said velocity output signal to a means for controlling the velocity of said trolley; and means for predicting velocity change by generating a velocity change signal based on a collection of prediction model correction acceleration signals, from said anti-sway controller, comparing said velocity change signal to said velocity output signal, generating a velocity compensation signal from said comparison, and factoring said velocity compensation signal into said operator's trolley velocity input signal.

2. The system of claim 1 wherein said means for generating a cancellation acceleration signal further comprises means for determining the length of said cable.

3. The system of claim 2 wherein said means for generating a cancellation acceleration signal further comprises means for generating a cable length signal from said determination of the length of said cable.

4. The system of claim 3 wherein said means for generating a cancellation acceleration signal further comprises means for determining the time derivative of the length of said cable.

5. The system of claim 4 wherein said means for generating a cancellation acceleration signal further comprises means for generating a cable velocity signal from said determination of the time derivative of said cable length.

6. The system of claim 5 wherein said means for generating a cancellation acceleration signal further comprises means for receiving said cable length signal, said cable velocity signal and said adjusted operator's command acceleration signal in an anti-sway controller to generate said cancellation acceleration signal.

7. The system of claim 4 wherein said cable length time derivative means is a sensor.

8. The system of claim 2 wherein said cable length determining means is a sensor.

9. The system of claim 1 wherein said means for generating an external factor reduction acceleration signal further comprises means for measuring a sway angle of said payload.

10. The system of claim 9 wherein said means for generating an external factor reduction acceleration signal further comprises means for generating a measured sway angle signal from said measured sway angle.

11. The system of claim 10 wherein said means for generating an external factor reduction acceleration signal further comprises means for measuring a sway velocity of said payload.

12. The system of claim 11 wherein said means for generating an external factor reduction acceleration signal further comprises means for generating a measured sway velocity signal from said measured sway velocity.

13. The system of claim 12 wherein said means for generating an external factor reduction acceleration signal further comprises means for generating a model sway signal in said anti-sway controller.

14. The system of claim 13 wherein said means for generating an external factor reduction acceleration signal further comprises means for generating a model sway velocity signal in said anti-sway controller.

15. The system of claim 14 wherein said means for generating an external factor reduction acceleration signal further comprises means for receiving said model sway angle signal from said anti-sway controller into a means for external sway control.

16. The system of claim 15 wherein said means for generating an external factor reduction acceleration signal further comprises means for receiving said model sway velocity signal from said anti-sway controller into said external sway control means.

17. The system of claim 16 wherein said means for generating an external factor reduction acceleration signal further comprises means for receiving said measured sway angle signal into said external sway control means.

18. The system of claim 17 wherein said means for generating an external factor reduction acceleration signal further comprises means for receiving said measured sway velocity signal into said external sway control means.

19. The system of claim 18 wherein said means for generating an external factor reduction acceleration signal further comprises means for generating said external factor reduction acceleration signal based on said model sway angle signal, said model sway velocity signal, measured sway angle signal and said measured sway velocity signal.

20. The system of claim 11 wherein said way velocity measuring means is a sensor.

21. The system of claim 20 wherein said sensor is an infrared beach system.

22. The system of claim 9 wherein said sway angle measuring means is a sensor.

23. The system of claim 22 wherein said sensor is an infrared beacon system.

24. The system of claim 1 wherein said means for generating a velocity output signal further comprises means for receiving said adjusted operator's command signal, cancellation acceleration signal and said external factor reduction acceleration signal.

25. The system of claim 1 further comprising a means for filtering said operator's trolley velocity input signal to set a maximum allowable velocity of said trolley and said maximum allowable velocity filtering means generating a velocity demand signal.

26. The system of claim 25 further comprising means for filtering said velocity demand signal by differentiating said velocity demand signal with respect to time to compute a reference acceleration signal and further by reducing the magnitude of the said reference acceleration signal by one-half to account for the delayed effect of the cancellation acceleration signal.

27. The system of claim 26 further comprising means for saturation control of said adjusted operator's command acceleration, wherein said saturation control means receives said velocity demand signal, said external factor reduction acceleration signal and said cancellation acceleration signal to generate said adjusted operator's command acceleration.

28. The system of claim 1 further comprising a means for filtering said operator's hoist velocity input signal to set a maximum allowable velocity of said hoist, said hoist velocity input signal filtering means generating a cable velocity demand signal, and said cable velocity demand signal is sent to a hoisting controller.

29. The system of claim 1 further comprising means for filtering said operator's trolley velocity input signal by differentiating said operation's trolley velocity input signal with respect to time to compute a reference acceleration signal and further by reducing the magnitude of said reference acceleration signal by one-half to account for the delayed effect of the cancellation acceleration signal.

30. The system of claim 29 wherein said model sway angle signal is generated based on a family of ordinary differential equations.

31. The system of claim 29 wherein said model sway velocity signal is generated based on a family of ordinary differential equations.

32. The system of claim 29 wherein a collection of prediction model correction acceleration signals are generated based on a family of ordinary differential equations.

33. The system of claim 1 further comprising means for saturation control of said adjusted operator's command acceleration signal.

34. The system of claim 1 wherein said cancellation acceleration signal is generated based on a family of ordinary differential equations.

35. A system for eliminating sway of a payload suspended by a cable attached to a hoist from a trolley, the position of said payload being vertically and, horizontally adjustable, said system including means for generating an operator's hoist velocity input signal for vertical adjustment of said payload and including means for generating an operator's trolley velocity input signal for horizontal translation of said payload suspended by said cable, said system comprising:

means for generating an adjusted operator's command acceleration signal from said operator's trolley velocity input signal;

means for generating a cancellation acceleration signal in an anti-sway controller, wherein said cancellation acceleration signal generation means comprises:

means for determining the length of said cable;

means for generating a cable length signal from said determination of the length of said cable;

means for determining the time derivative of the length of said cable;

means for generating a cable velocity signal from said determination of the time derivative of said cable length; and means for receiving said cable length signal, said cable velocity signal and said adjusted operator's command acceleration signal in said anti-sway controller to generate said cancellation acceleration signal based on a family of ordinary differential equations;

means for generating an external factor reduction acceleration signal in a means for controlling external sway, said external factor reduction acceleration signal generation means comprising:

means for measuring a sway angle of said payload;

means for generating a measured sway angle signal from said measured sway angle;

means for measuring a sway velocity of said payload;

means for generating a measured sway velocity signal from said measured sway velocity;

means for generating a model sway signal in said anti-sway controller;

means for generating a model sway velocity signal in said anti-sway controller;

means for receiving said model sway angle signal from said anti-sway controller into said external sway control means;

means for receiving said model sway velocity signal from said anti-sway controller into said external sway control means;

means for receiving said measured sway angle signal into said external sway control means;

means for receiving said measured sway velocity signal into said external sway control means; and means for generating said external factor reduction acceleration signal based on said model sway angle signal, said model sway velocity signal, measured sway angle signal and said measured sway velocity signal;

means for generating a velocity output signal in a means for generating velocity output, said velocity output signal generation comprises:

means for receiving said adjusted operator's command acceleration signal;

means for receiving said cancellation acceleration signal;

means for receiving said external factor reduction acceleration signal; and means for generating a velocity output signal in said means for generating velocity output based on said adjusted operator's command acceleration signal, said cancellation acceleration signal and said external factor reduction acceleration signal;

means for sending said velocity output signal from said means for generating velocity output to a means for controlling velocity of the said trolley; and means for predicting velocity change in a means for predicting velocity change, said velocity change prediction comprising:

means for generating a collection of prediction model correction acceleration signals in said anti-sway controller;

means for generating a velocity change signal using said collection of prediction model correction acceleration signals of said anti-sway controller;

means for comparing said velocity change signal to said velocity output signal;

means for generating a velocity compensation signal from said comparison; and means for factoring said velocity compensation signal into said operator's trolley velocity input signal.

36. A method for eliminating sway of a payload suspended by a cable attached to a hoist from a trolley, the position of said payload being vertically and horizontally adjustable, said method including means for generating an operator's hoist velocity input signal for vertical adjustment of said payload and including means for generating an operator's trolley velocity input signal for horizontal translation of said payload suspended by said cable, said method comprising:

generating an adjusted operator's command acceleration signal from said operator's trolley velocity input signal;

generating a cancellation acceleration signal using the length of said cable, the time derivative of the length of said cable, and said adjusted operator's command acceleration signal;

generating an external factor reduction acceleration signal using a measured sway angle of said payload, a measured sway velocity of said payload, a model sway angle of said payload and a model sway velocity of said payload;

generating a velocity output signal based on said adjusted operator's command acceleration signal, said cancellation acceleration signal and said external factor reduction acceleration signal;

sending said velocity output signal to a means for controlling the velocity of the said trolley; and predicting velocity change by generating a velocity change signal based on a collection of prediction model correction acceleration signals from said controller, comparing said velocity change signal to said velocity output signal, generating a velocity compensation signal from said comparison, and factoring said velocity compensation signal into said trolley velocity input signal.

37. The method of claim 36 wherein said cancellation acceleration is generated based on a family of ordinary differential equations.

38. The method of claim 36 wherein said model sway angle signal is generated based on a family of ordinary differential equations.

39. The method of claim 36 wherein said model sway velocity signal is generated based on a family of ordinary differential equations.

40. The method of claim 36 wherein said compensation signals are generated based on a family of ordinary differential equations.

41. The method of claim 36 further comprising filtering said operator's trolley velocity input signal and filtering said velocity compensation signal.

42. The method of claim 41 further comprising generating an adjusted operator's command acceleration signal from said filtered operator's trolley velocity input signal and from said velocity compensation signal.

43. A method for eliminating sway of a payload suspended by a cable attached to a hoist from a trolley, the position of said payload being vertically and horizontally adjustable, said method including means for generating an operator's hoist velocity input signal for vertical adjustment of said payload and including means for generating an operator's trolley velocity input signal for horizontal translation of said payload suspended by said cable, said method comprising:

generating an adjusted operator's command acceleration signal from said operator's trolley velocity input signal;

generating a cancellation acceleration signal in an anti-sway controller, wherein said generation of said cancellation acceleration signal comprises:

determining the length of said cable;

generating a cable length signal from said determination of the length of said cable;

determining the time derivative of the length of said cable;

generating a cable velocity signal from said determination of the time derivative of said cable length; and receiving said cable length signal, said cable velocity signal and said adjusted operator command acceleration signal in said anti-sway controller to generate said cancellation acceleration signal based on a family of ordinary differential equations;

generating an external factor reduction acceleration signal in a means for controlling sway due to external factors, said external factor reduction acceleration signal generation comprising:

measuring a sway angle of said payload;

generating a measured sway angle signal from said measured sway angle;

measuring a sway velocity of said payload;

generating a measured sway velocity signal from said measured sway velocity;

generating a model sway signal in said anti-sway controller;

generating a model sway velocity signal in said anti-sway controller;

receiving said model sway angle signal from said anti-sway controller into said external sway control means;

receiving said model sway velocity signal from said anti-sway controller into said external sway control means;

receiving said measured sway angle signal into said external sway control means;

receiving said measured sway velocity signal into said external sway control means; and generating said external factor reduction acceleration signal based on said model sway angle signal, said model sway velocity signal, measured sway angle signal and said measured sway velocity signal;

generating a velocity output signal in a means for generating velocity output, said velocity output signal generation comprises:

receiving said adjusted operator's command acceleration signal;

receiving said cancellation acceleration signal;

receiving said external factor reduction acceleration signal; and generating a velocity output signal in said means for generating velocity output based on said adjusted operator's command acceleration signal, said cancellation acceleration signal and said external factor reduction acceleration signal;

sending said velocity output signal from said means for generating velocity output to a means for controlling velocity of said trolley; and predicting velocity change in a means for predicting velocity change, said velocity change prediction comprising:

generating compensation signals in said anti-sway controller;

generating a velocity change signal using said compensation signals of said anti-sway controller;

comparing said velocity change signal to said velocity output signal;

generating a velocity compensation signal from said comparison; and factoring said velocity compensation signal into said operator's trolley velocity input signal.

* * * * *

UNITED STATES PATENT AND TRADEMARK OFFICE

CERTIFICATE OF CORRECTION

PATENT NO. : 6,588,610 B2
DATED : July 8, 2003
INVENTOR(S) : Chong-Jin Ong et al.

It is certified that error appears in the above-identified patent and that said Letters Patent is hereby corrected as shown below:

Title page,
Item [56], References Cited, FOREIGN PATENT DOCUMENTS, insert:

-- EP 0 841 295 A2 published 05/13/98
EP 0 841 295 A3 published 01/12/00 --

Signed and Sealed this

Tenth Day of August, 2004

JON W. DUDAS
*Acting Director of the United States Patent and Trademark Office*